US005524772A

United States Patent [19]

Simmons

[11] Patent Number: 5,524,772

[45] Date of Patent: Jun. 11, 1996

[54] LOCKING GUN RACK

[76] Inventor: James D. Simmons, 210 Gay St., Warrensburg, Mo. 64093

[21] Appl. No.: 326,385

[22] Filed: Oct. 20, 1994

[51] Int. Cl.[6] ..... A47F 5/00

[52] U.S. Cl. ..... 211/4; 211/64; 211/87; 248/291.1; 224/913; 224/546

[58] Field of Search ..... 211/64, 105.1, 211/105.2, 70.8, 4, 87; 248/291; 224/311, 327, 913, 922, 402, 546, 550, 555

[56] References Cited

U.S. PATENT DOCUMENTS

| | | | |
|---|---|---|---|
| 2,823,808 | 2/1958 | Hindi | 211/64 |
| 3,294,247 | 12/1966 | Norrington | 224/546 X |
| 3,618,785 | 11/1971 | Newman . | |
| 3,643,811 | 2/1972 | Howerton . | |
| 3,767,093 | 10/1973 | Pinkerton et al. . | |
| 3,857,491 | 12/1974 | Townsend et al. . | |
| 3,931,893 | 1/1976 | Elkins et al. . | |
| 4,139,100 | 2/1979 | Reed . | |
| 4,450,989 | 5/1984 | Bogar | 224/546 X |
| 4,596,334 | 6/1986 | Daulton . | |
| 4,776,471 | 10/1988 | Elkins | 211/64 |
| 5,078,279 | 1/1992 | Hancock et al. . | |
| 5,350,094 | 9/1994 | Morford | 224/913 X |

*Primary Examiner*—Robert W. Gibson, Jr.
*Attorney, Agent, or Firm*—Litman, McMahon and Brown

[57] ABSTRACT

Each of a set of locking gun rack assemblies includes an elongated vertical frame member having a pair of firearm support cradles extending therefrom in vertically spaced relation. A fixed mounting bracket is formed at a lower end of the frame member; however, an upper end of the frame member has a mounting bracket pivotally connected thereto to facilitate connection of the rack assemblies to the rear wall of a pickup truck cab in which the rear wall curves forwardly into the roof structure of the cab immediately above a rear window of the cab. An upper cradle of one assembly of the set and a lower cradle of the other assembly are provided with a pivotally connected firearm keeper which engages the outer end of the associated cradle and is secured in place by a padlock.

14 Claims, 1 Drawing Sheet

LOCKING GUN RACK

BACKGROUND OF THE INVENTION

The present invention relates to gun racks for pickup trucks and, more particularly, to such a rack including a pivotally connected bracket to facilitate attaching such a rack to an irregular surface.

Gun racks are often mounted inside the rear windows of pickup trucks by hunters and other shooters to provide a safe place to carry long or shoulder firearms such as rifles, carbines, shotguns, and the like in such a vehicle. Such racks generally include a vertical member having its ends attached to sheet metal of the cab of the pickup truck above and below the rear window and one or more gun support cradle members extending from the vertical member to receive one end of a firearm, such as the pistol grip or forearm or barrel of such a firearm. Some types of racks are adapted for mounting in the framework or insulation structure supporting the rear window of a pickup. Normally, the racks are used in pairs to support the ends of a firearm.

Because firearms mounted on a rack in the rear window of a pickup truck are visible, they are vulnerable to theft. Thus, it is desirable for such gun racks to be capable of being locked, for the rack structures to be sturdy, and for the racks to be securely attached to structure within the pickup cab. Hunters often drive their vehicles on unimproved rural roads, and often off-road. Because of this, the rack structures also need to be sturdy enough to retain firearms supported thereon and remain attached to the cab structure when the vehicle is driven over rough terrain. Separation of the guns from the rack or of the racks with guns thereon could be hazardous to the driver and any passenger, as well as damaging to the firearms.

Most types of gun racks are designed to be attached to cab structure in a laterally oriented vertical plane. There are many small and middle size pickup trucks, and even some full size pickups, in which the cab structure begins to curve forward immediately above the top of the rear window. Most types of gun racks are not well designed for attachment to cab structure of such a configuration. Racks which attach to the rear window insulation avoid this problem. However, attachment of gun racks to the rear window insulation, such as by sliding under the edge of the insulation, is generally not as secure as would be desired.

SUMMARY OF THE INVENTION

The present invention provides an improved gun rack set which provides for secure attachment to cab structure of a pickup truck, secure retention of firearms on the rack set, and the capability of installation in a wide variety of pickup trucks. Each of the racks of the present invention includes an elongated frame member with a pair of firearm cradles extending from a front side of the frame member. A lower end of the frame member has a fixed attachment bracket; however, at an upper end, an attachment bracket is pivotally connected to the frame member to provide flexibility for installing the gun rack sets in pickup truck cabs in which the rear cab wall curves forward into the cab roof immediately above the top edge of the rear window.

Preferably, one of the cradles on each rack has a firearm keeper pivotally connected to the frame member and is engageable with an upper end of the associated firearm cradle whereby a lock member, such as a padlock, received in the end of the cradle locks the keeper to prevent unauthorized removal of a firearm from the rack. The upper cradle on one rack of a set and the lower cradle on the other rack are provided with keepers and locks so that firearms can be received in aligned cradle sets pointing in opposite directions. Each rack has the frame member and cradle formed integrally, as of cast aluminum, with an overall I-beam cross section to provide a sturdy, light, and relatively inexpensive firearm supporting structure for a pickup truck cab.

OBJECTS AND ADVANTAGES OF THE INVENTION

The principal objects of the present invention are: to provide an improved structure for support long firearms in vehicles; to provide, particularly, an improved set of gun racks for holding firearms such as rifles, shotguns, and the like in the rear window of a pickup truck; to provide such gun racks having the capability of being mounted in a wide variety of pickup trucks; to provide such gun racks including an elongated vertical frame member having a fixed mounting bracket at a lower end and a pivotally connected mounting bracket at an upper end to facilitate attaching the rack to the cab structure of a pickup truck in which the rear wall curves forward into the roof of the cab immediately above the top edge of the rear window; to provide such a rack including a pair of vertically spaced firearm support cradles extending forwardly from the vertical frame member; to provide a set of such gun racks in which the upper cradle on one rack and the lower cradle on the other rack are each provided with a pivotally connected firearm keeper and a lock to lock a firearm in each of the aligned cradles on the set of gun racks; to provide such a gun rack in which the frame member, cradles, and fixed bracket are integrally formed of aluminum by casting and in which the cast frame assembly has a generally I-beam cross section for strength; and to provide such a set of gun racks which are economical to manufacture, which are secure in their installations, and which are particularly well adapted for their intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 1:
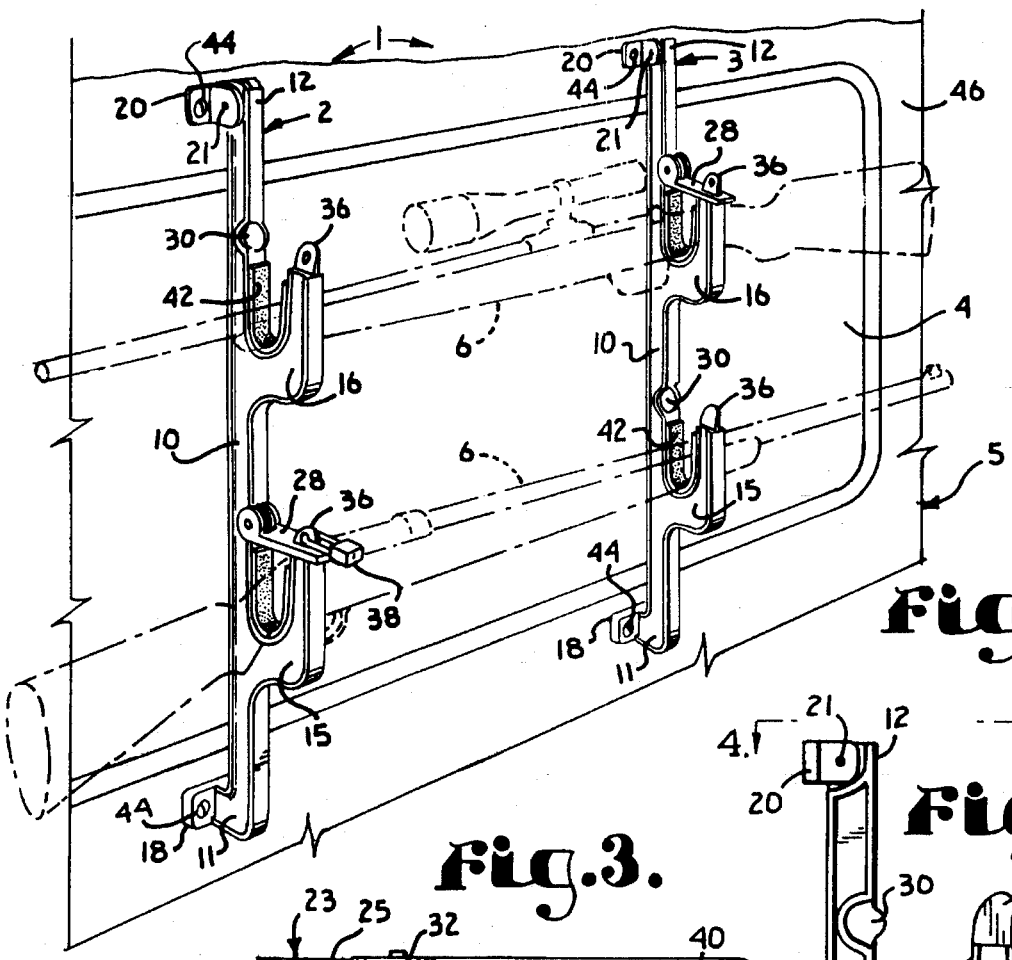
FIG. 1 is a fragmentary perspective view illustrating a pair of locking gun racks which embody the present invention installed in front of a rear window of a pickup truck cab, with a pair of firearms shown in phantom lines supported by the set of gun racks.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference numeral 1 generally designates a set of gun rack assemblies 2 and 3 which embody the present invention. The assemblies 2 and 3 are mounted in front of the window 4 of a pickup truck cab 5 to enable safe, secure, and convenient carrying of firearms 6 in a vehicle, as by hunters, farmers, ranchers, target shooters, law enforcement officers, and the like. The rack assemblies 2 and 3 are also capable of being attached to a wall, as of a closet or large gun safe or over a fireplace, in a building.

Figure 2:
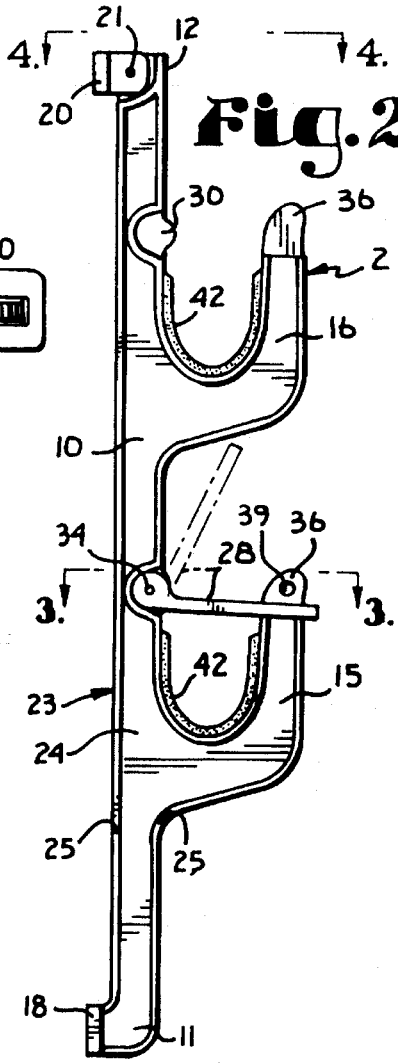
FIG. 2 is an enlarged side elevational view of one of the gun racks, with an opened position of a firearm keeper member shown in phantom lines.

The rack assemblies 2 and 3 are similar and the structural description will, for convenience, be directed to rack assembly 2 shown in FIG. 2. The rack assembly 2 includes an elongated vertical frame member 10 having a lower end 11 and an upper end 12. A lower firearm cradle 15 and an upper firearm cradle 16 extend forwardly and up from the frame member 10 in vertically spaced relation. A fixed lower mounting bracket 18 is formed at the lower end 11 of the frame member 10, and an upper mounting bracket 20 is pivotally connected to the upper end 12 of the frame member 10, as by a roll pin 21 or other pivotal fastener.

Figure 3:
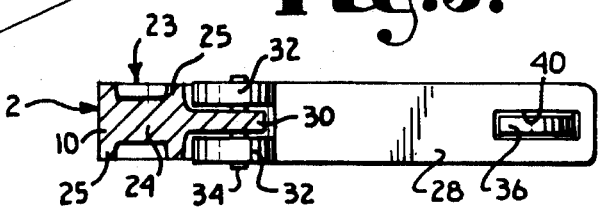
FIG. 3 is a further enlarged horizontal sectional view taken on line 3—3 of FIG. 2 and illustrates details of the pivotal connection of the firearm keeper to the frame member of one of the gun racks of the present invention.
Figure 4:
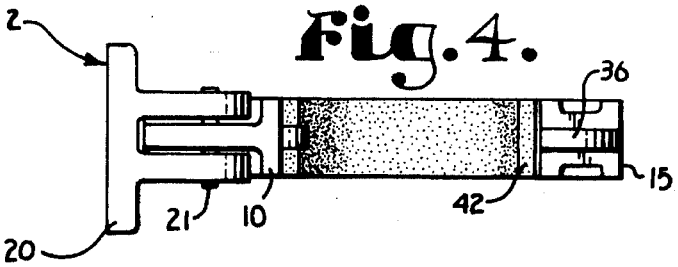
FIG. 4 is an enlarged top plan view taken on line 4—4 of FIG. 2 and illustrates details of the pivotal connection of an upper mounting bracket to the frame member of the gun rack.

On each of the illustrated rack assemblies 2 and 3, the frame member 10, cradles 15 and 16, and lower mounting bracket 18 are formed as an integral rack assembly blank 23 by casting aluminum. Alternatively, other configurations, materials, and manufacturing methods may be employed to form the rack assemblies 2 and 3 of the present invention. As illustrated particularly in FIG. 3, each blank 23 has a generally I-beam cross section including a central web 24 and peripheral flanges 25. The illustrated and preferred construction of the blanks 23 give the rack assemblies 2 and 3 a high degree of sturdiness and rigidity while being light in weight.

The illustrated rack assemblies 2 and 3 are formed from identical blanks 23 and may be identical as finished assemblies. However, for economy and for convenience of use, there are differences between the assemblies 2 and 3. On one rack assembly, such as rack assembly 2, the lower cradle 15 is provided with a firearm keeper 28, and on the other rack assembly 3, the upper cradle 16 is provided with a firearm keeper 28. The frame member 10 is provided with mounting tabs 30 which are extensions of the web 24 of the rack assembly blanks 23. The flanges 25 of the frame members 10 are recessed in the area of the tabs 30. On tabs 30 on which a keeper 28 is to be installed, the tabs are drilled.

Each firearm keeper 28 is bifurcated at its inner end to form a pair of mounting ears 32. The ears 32 are drilled and receive a pivot fastener 34, such as a steel roll pin, which pivotally connects the keeper 28 to the frame member 10. The outer and upper ends of the cradles 15 and 16 are each provided with an upstanding lock tang 36 which is an extension of the web 24 of the cradle member 15 or 16. On tangs 36 of the cradle members 15 and 16 which are provided with keepers 28, the tangs 36 are drilled to receive a locking device 38, such as a small padlock, in an aperture 39 formed in the tangs 36. The keepers 28 are provided with slots 40 near their outer ends which fit about the tangs 36 in the closed or locked positions of the keepers 28. The cradles 15 and 16 of the illustrated rack assemblies 2 and 3 are lined with pad strips 42 to avoid scratching or marring portions of the firearms 6 supported by the rack assemblies.

Figure 5:
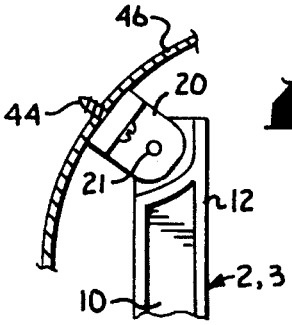
FIG. 5 is an enlarged fragmentary side elevational view illustrating a pivoted position of the upper mounting bracket of the gun rack of the present invention to enable attachment of the gun rack to a curved, or otherwise irregular, support wall.

The rack assembly set 1 is installed in the cab 5 of a pickup truck by passing screws 44 through the fixed brackets 18 and the pivotal brackets 20 into sheet metal 46 or other materials forming the structure of the cab 5 of a pickup truck or other base structure intended to support the rack set 1. As shown in FIG. 5, the pivotability of the upper bracket 20 accommodates curvature of the sheet metal 46 above the window 4 of a pickup truck cab 5. Although only the upper bracket 20 is illustrated to be pivotally attached to the rack frame member 10, it should be noted that the rack assemblies 2 and 3 could be configured such that the lower brackets 18 are identical to the brackets 20 and pivotally connected to the frame member 10 to accommodate curvature of a lower supporting surface.

In the configuration illustrated, one upper cradle 16 of one rack assembly and one lower cradle 15 of the other rack assembly are provided with firearm keepers 28. As such, the rack set 1 is capable of supporting two firearms 6 in opposed orientation. Preferably, a pistol grip section of each firearm 6 is received in a cradle 15 or 16 provided with a keeper 28, while the forearm or barrel of each firearm 6 rests on the corresponding cradle aligned therewith. When the keepers 28 are locked onto a cradle 15 or 16 supporting the pistol grip of a firearm 6, using the padlocks 38, removal of the firearm 6 is prevented. Alternatively, both cradles 15 and 16 of one rack assembly 203 could be provided with keepers 28, or both the cradles 15 and 16 of both rack assemblies 2 and 3 could be lockable. And while the rack set 1 has been described and illustrated primarily with reference to mounting within the cab 5 of a vehicle, the rack set 1 could also be mounted on a wall within a building.

It is to be understood that while certain forms of the present invention have been illustrated and described herein, it is not to be limited to the specific forms or arrangement of parts described and shown.

What is claimed and desired to be secured by Letters Patent is as follows:

1. A firearm rack assembly comprising:

(a) an elongated frame member having an upper end and an opposite lower end;

(b) an upper firearm cradle member and a lower firearm cradle member extending from said frame member intermediate said upper and lower ends in longitudinally spaced mutual relation, each of said cradle members being adapted to supportingly receive a portion of a respective firearm therein;

(c) a lower attachment bracket positioned at said lower end of said frame member;

(d) an upper attachment bracket pivotally connected to said frame member at said upper end to facilitate attachment of said frame member to a surface having an irregular orientation at a position where said upper bracket is to be attached;

(e) each of said cradle members including:

(1) a web extension formed at an inner end of said cradle member adjacent said frame member;

(2) a tab extending from an outer end of said cradle member opposite said inner end; and (3) said web extension and said tab being substantially aligned.

2. An assembly as set forth in claim 1 wherein one of said cradle members includes:

(a) a lock receiver formed on an outer end of said one cradle member;

(b) a firearm keeper pivotally connected to said frame member at a position to engage said lock receiver; and (c) said lock receiver and said keeper cooperate with a locking device to releasably secure a firearm in said one cradle member.

3. An assembly as set forth in claim 1 wherein one of said cradle members includes:

(a) a firearm keeper having one end pivotally connected to said web extension and having a slot at an opposite end positioned to receive said tab therein when said keeper is pivoted toward said tab; and (b) said tab having a lock device receiving formation thereon to receive a lock device to prevent said keeper from being pivoted away from said tab to thereby releasably secure a portion of a firearm in said one cradle member.

4. An assembly as set forth in claim 3 wherein said assembly is a first firearm rack assembly having said keeper on an upper cradle member thereof in combination with:

(a) a second firearm rack assembly substantially similar to said first firearm rack assembly with said keeper on a lower cradle member thereof.

5. An assembly as set forth in claim 1 wherein one of said cradle members includes:

(a) means forming a pivot aperture through the web extension of said one cradle member;

(b) a firearm keeper having a pivot yoke at one end and a slot at an opposite end, said keeper being pivotally connected to said frame member by a pivot fastener engaged with said yoke and extending through said pivot aperture; and (c) said tab having a lock receiving aperture formed therethrough to receive a lock device to prevent said keeper from being pivoted away from said tab to thereby releasably secure a portion of a firearm in said one cradle member.

6. An assembly as set forth in claim 1 and including:

(a) a respective padding strip lining an internal surface of each of said cradle members.

7. An assembly as set forth in claim 1 wherein:

(a) said frame member and said upper and lower cradle members are formed integrally as a one piece structure.

8. An assembly as set forth in claim 7 wherein:

(a) said one piece structure is formed of aluminum by casting.

9. An assembly as set forth in claim 8 wherein:

(a) said one piece structure has a generally I-shaped cross section.

10. A firearm rack assembly comprising:

(a) a first firearm rack component and a second firearm rack component, each component including:

(1) an elongated frame member having an upper end and an opposite lower end;

(2) an upper firearm cradle member and a lower firearm cradle member extending from said frame member intermediate said upper and lower ends in longitudinally spaced mutual relation, each of said cradle members being adapted to supportingly receive a portion of a respective firearm therein;

(3) a lower attachment bracket positioned at said lower end of said frame member; and (4) an upper attachment bracket pivotally connected to said frame member at said upper end to facilitate attachment of said frame member to a surface having an irregular orientation at a position where said upper bracket is to be attached;

(b) said firearm rack components being adapted for mounting in laterally spaced relation with respective upper and lower cradle members of said components generally aligned whereby the aligned upper cradle members are positioned to support a first shoulder firearm and the aligned lower cradle members are positioned to support a second shoulder firearm;

(c) each of said cradle members including:

(1) a web extension formed at an inner end of the associated cradle member adjacent the associated frame member;

(2) a tab extending from an outer end of said associated cradle member opposite said inner end; and (3) said web extension and said tab being substantially aligned; and (d) said first component including a first firearm lock on the upper cradle member thereof and said second component including a second firearm lock on the lower cradle member thereof, each of said firearm locks functioning in cooperation with the web extension and the tab of the associated cradle member to releasably secure a portion of a firearm in the respective cradle member.

11. An assembly as set forth in claim 10 wherein each of said firearm locks includes:

(a) a firearm keeper having one end pivotally connected to said web extension of the associated cradle member and having a slot at an opposite end positioned to receive the tab of the associated cradle member therein when said keeper is pivoted toward said tab; and (b) said tab having a lock device receiving formation thereon to receive a lock device to prevent said keeper from being pivoted away from said tab to thereby releasably secure a portion of a firearm in the associated cradle member.

12. An assembly as set forth in claim 10 and including:

(a) a respective padding strip lining an internal surface of each of said cradle members.

13. An assembly as set forth in claim 10 wherein:

(a) each firearm rack component has the associated frame member and upper and lower cradle members formed integrally as a one piece structure.

14. An assembly as set forth in claim 13 wherein:

(a) said one piece structure is formed of aluminum by casting; and (b) said one piece structure has a generally I-shaped cross section.

* * * * *